US010397685B2

(12) United States Patent
Ogata et al.

(10) Patent No.: US 10,397,685 B2
(45) Date of Patent: Aug. 27, 2019

(54) EARPHONE

(71) Applicant: DAI-ICHI SEIKO CO., LTD., Kyoto-shi, Kyoto (JP)

(72) Inventors: Kenji Ogata, Ogori (JP); Akihiko Hosaka, Tokyo (JP); Yoshiyuki Watanabe, Tokyo (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/580,609

(22) PCT Filed: Jun. 8, 2016

(86) PCT No.: PCT/JP2016/067087
§ 371 (c)(1),
(2) Date: Dec. 7, 2017

(87) PCT Pub. No.: WO2016/204045
PCT Pub. Date: Dec. 22, 2016

(65) Prior Publication Data

US 2018/0160209 A1 Jun. 7, 2018

(30) Foreign Application Priority Data

Jun. 17, 2015 (JP) ..... 2015-122034

(51) Int. Cl.
*H04R 17/00* (2006.01)
*H04R 1/10* (2006.01)
*H04R 1/28* (2006.01)

(52) U.S. Cl.
CPC ..... *H04R 1/1016* (2013.01); *H04R 1/1058* (2013.01); *H04R 1/1075* (2013.01);
(Continued)

(58) Field of Classification Search
CPC ..... H04R 25/606; H04R 2460/13
See application file for complete search history.

(56) References Cited

U.S. PATENT DOCUMENTS 4,150,262 A * 4/1979 Ono ..... H04M 1/62 381/190
6,643,378 B2 * 11/2003 Schumaier ..... H04R 25/606 381/318

(Continued)

FOREIGN PATENT DOCUMENTS

CN 1929700 A 3/2007
CN 101827297 A 9/2010

(Continued)

OTHER PUBLICATIONS

International Search Report and Written Opinion (International Application No. PCT/JP2016/067087) dated Aug. 9, 2016; Includes English Translation of International Search Report; 8 pages.

(Continued)

*Primary Examiner* — Curtis A Kuntz
*Assistant Examiner* — Ryan Robinson
(74) *Attorney, Agent, or Firm* — Howard & Howard Attorneys PLLC

(57) ABSTRACT

An earphone (1) is provided that includes a first vibration plate (31) for vibration by a first piezoelectric element (32) and a cylindrically-shaped casing (2) for transmission of the vibration of the first vibration plate (31) to ear canal cartilage. The first vibration plate (31) is disposed inside the casing (2). The earphone (1) has a structure whereby an amount of sound leakage, which is due to transmission of the vibration of the first vibration plate (31) to the air, is low. The ear canal cartilage transmits sound to the eardrum of only one ear, thereby enabling localization of sound. The woofer (3) maintains sound pressure at low frequencies.

7 Claims, 5 Drawing Sheets

(52) U.S. Cl.
CPC ..... *H04R 1/288* (2013.01); *H04R 17/00* (2013.01); *H04R 2201/10* (2013.01); *H04R 2460/11* (2013.01); *H04R 2460/13* (2013.01)

(56) References Cited

U.S. PATENT DOCUMENTS

| | | | | |
|---|---|---|---|---|
| 8,005,249 | B2 * | 8/2011 | Wirola | H04R 1/1016 381/190 |
| 9,025,795 | B2 * | 5/2015 | Adachi | H04R 11/02 381/151 |
| 2007/0057601 | A1 | 3/2007 | Kawase et al. | |
| 2009/0220115 | A1 * | 9/2009 | Lantrua | H04R 25/606 381/326 |
| 2016/0182993 | A1 * | 6/2016 | Ikeda | H04R 1/1016 381/328 |
| 2016/0248894 | A1 * | 8/2016 | Hosoi | H04M 1/03 |
| 2017/0188126 | A1 * | 6/2017 | Hirano | H04R 1/10 |

FOREIGN PATENT DOCUMENTS

| | | | |
|---|---|---|---|
| CN | 202889578 | U | 4/2013 |
| JP | 57-041380 | U1 | 3/1982 |
| JP | 04-096599 | A | 3/1992 |
| JP | 2001-326985 | A | 11/2001 |
| JP | 2009-232443 | A | 10/2009 |
| JP | 2015-041977 | A | 3/2015 |
| JP | 2015-053640 | A | 3/2015 |
| TW | 201215174 | A | 4/2012 |

OTHER PUBLICATIONS

First Office Action (CN Application No. 201680033932.3) dated Dec. 27, 2018; Includes English Translation; 20 pages.

Office Action (KR Application No. 10-2018-7001319) dated Jan. 8, 2019; Includes English Translation; 9 pages.

Office Action (TW Application No. 10721076160); dated Nov. 20, 2018; 5 pages.

* cited by examiner

EARPHONE

CROSS-REFERENCE TO RELATED APPLICATIONS

This application is a U.S. National Phase of International Application No. PCT/JP2016/067087, filed on Jun. 8, 2016, which claims the benefit of Japanese Patent Application No. 2015-122034, filed Jun. 17, 2015, including the specification, claims, and drawings, the entire disclosures of which is incorporated by reference herein.

TECHNICAL FIELD

The present disclosure relates to an earphone for transmitting sound by bone conduction.

BACKGROUND ART

A bone-conduction type earphone is known that causes a vibration device contacting the ear to vibrate due to an audio signal, and that transmits such vibration to the cochlear duct (also called the "scala media") in the inner ear via bone to thus allow auditory nerves floating in the lymph fluid to sense sound recorded in the audio signal.

The bone-conduction type earphone transmits sound without sealing air in the ear canal, and even while listening to music, a listener can thus recognize ambient sounds such as human voices. However, the sound transmitted to the cochlear duct is transmitted to the eardrums of both ears, and thus localization of sound (lateral separation) is insufficient.

In this context, Patent Literature 1 discloses an earphone that transmits sound to the ear canal cartilage. However, the structure of the disclosed earphone does not allow the vibration of the vibration device to be sufficiently transmitted to the ear canal cartilage. That is to say, a majority of the energy of vibration is transmitted to the ambient air. This transmission generates so-called "sound leakage" so that people in the vicinity are inconvenienced during use of the earphone. Further, sound is transmitted by vibration of an object that has mass rather than by compression waves in air, and thus high frequency vibration is difficult, and sound characteristics at high frequencies deteriorate.

CITATION LIST

Patent Literature

Patent Literature 1: Unexamined Japanese Patent Application Kokai Publication No. 2015-053640.

SUMMARY OF INVENTION

Technical Problem

The objective of the present disclosure is to provide a bone-conduction type earphone that has high sound quality, that enables localization of sound, and that has a low amount of sound leakage.

Solution to Problem

In order to attain the aforementioned objective, the earphone of the present disclosure includes:

a first vibration plate for vibration by a first piezoelectric element; and a casing disposed with the first vibration plate, for transmitting to an ear canal cartilage the vibration of the first vibration plate.

The casing has a cylindrical shape, and the first vibration plate is disposed within the casing.

Due to such configuration, the cylindrically-shaped casing closely contacts the ear canal cartilage, and most of the vibration of the first vibration plate can be transmitted to the ear canal cartilage. Further, the first vibration plate is disposed within the casing, and the air receiving the vibration of the first vibration plate can be sealed within the casing.

In the earphone of the present disclosure, the casing includes a supporting member arranged radially as viewed in a cross section of the cylindrical shape of the casing. One end of the first vibration plate connects to the supporting member, and the first vibration plate is disposed along an axis of the cylindrical shape of the casing.

Due to this configuration, the first vibration plate and the casing, as an assembly, vibrates stably like a tuning fork.

In the earphone of the present disclosure, the first vibration plate includes a weight disposed at another end of the first vibration plate opposite to the end of the first vibration plate connecting to the supporting member.

Due to this configuration, a resonant frequency (F0) of the first vibration plate can be lowered, and the resultant low range frequency characteristics are favorable.

In the earphone of the present disclosure, the supporting member is disposed at an ear canal side of the casing.

Due to this configuration, the vibration of the first vibration plate is transmitted from the ear canal side. Thus the vibration that is not transmitted to the ear canal cartilage to become sound leakage is decreased.

The earphone of the present disclosure includes at least two of the first vibration plates, and among the at least two first vibration plates, two of the first vibration plates oscillate in mutually orthogonal directions.

Due to this configuration, two first vibration plates are present that oscillate in orthogonal directions. Thus the vibration is little affected by shape of the supporting member and/or the casing, and the vibration is reliably transmitted to the ear canal cartilage.

The earphone of the present disclosure includes the casing and an earphone main body, and the earphone includes a vibration transmission damping mechanism disposed between the casing and the earphone main body.

Due to this configuration, a decreased amount of the vibration is transmitted to the earphone main body, and sound leakage decreases.

The earphone of the present disclosure includes: a second vibration plate for vibration by a second piezoelectric element, and a hole, disposed in the casing, for transmitting to the ear canal an air vibration generated by the second vibration plate.

Due to this configuration, the vibration (mainly in the low frequencies) of the first vibration plate is transmitted to the ear canal cartilage, the earphone operates as the bone-conduction type earphone, the vibration (mainly in the high frequencies) of the second vibration plate can be transmitted to the eardrum as the air vibration, and sufficient sound pressure can be obtained in both the low frequencies and the high frequencies.

Advantageous Effects of Invention

According to the present disclosure, a bone-conduction type earphone is provided that enables localization of sound with high sound quality and has a low amount of sound leakage.

DESCRIPTION OF EMBODIMENTS

Figure 1:
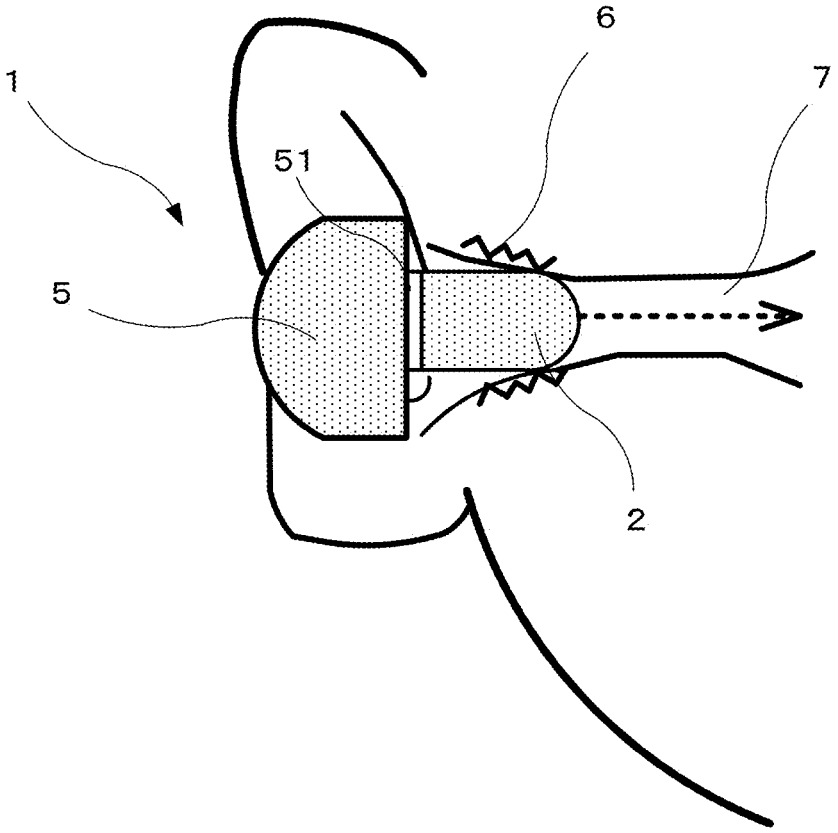
FIG. 1 is a drawing illustrating a state of use of an earphone.

FIG. 1 is a drawing illustrating a state of use of an earphone 1. The earphone 1 is inserted into an ear canal 7. The earphone 1 includes an earphone main body 5 that is not inserted in the ear canal 7 and a cylindrical casing 2 that is inserted in the ear canal 7, and a vibration of low frequencies is transmitted to ear canal cartilage 6 from the casing 2 inserted reliably in the ear canal 7. However, high frequency sound is transmitted to the ear canal 7 as an air vibration (compression wave) by a below-described tweeter 4.

A damping member 51 is disposed between the earphone main body 5 and the casing 2. The damping member 51 is formed from a material such as a flexible plastic and functions as a vibration transmission damping mechanism to lower transmission of the vibration of the casing 2 to the earphone main body 5. Due to inclusion of the damping member 51, transmission of the vibration of the casing 2 to the earphone main body 5 is difficult for the earphone 1, and sound leakage, which is caused by a vibration of the earphone main body 5 transmitted to the air, can be decreased. Further, the damping member 51 is sufficient when arranged only in the cylindrical portion of the casing 2, and the damping member 51 does not interfere with a hollow portion (having electrical wiring and the like) of the interior of the cylinder. That is to say, the damping member 51 is disposed along an inner wall of the casing 2 so as to not close the hollow portion.

Further, although a structure (tweeter 4) transmitting to the ear canal 7 high frequency sound as an air vibration and the damping member 51 are preferably further provided, these components may be omitted. Such components may be selected within the scope of a specific design.

Specific configurations of the casing 2 and a sound-generating vibration plate of the earphone 1 of the present disclosure are described below in embodiments.

Embodiment 1

Figure 2A:
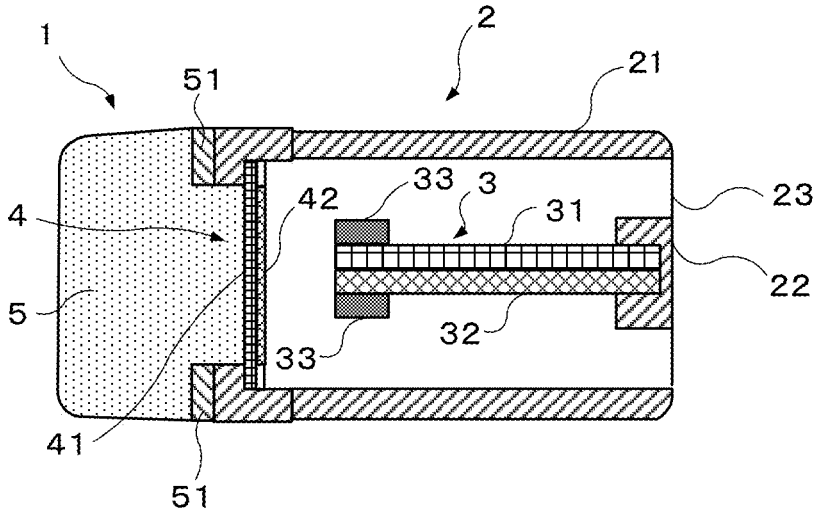
FIG. 2A is a schematic drawing (cross-sectional drawing of a casing) illustrating a configuration of the earphone (Embodiment 1)
Figure 2B:
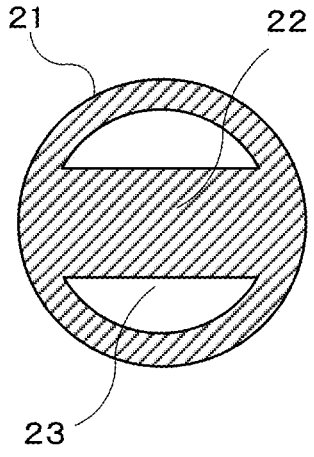
FIG. 2B is a schematic drawing (view of the casing as seen from the ear canal side) illustrating the configuration of the earphone (Embodiment 1)

FIG. 2A and FIG. 2B are schematic drawings illustrating the configuration of the earphone 1. FIG. 2A is a cross-sectional drawing of the casing 2, and FIG. 2B is a drawing of the casing 2 as viewed from the ear canal 7 side (from the right side as viewed in FIG. 2A). The casing 2 includes a supporting member 22 and a hole 23 arranged in a cylindrically-shaped earpiece (casing main body) 21.

The supporting member 22 is arranged at an ear canal 7 side end portion of the casing 2 and is arranged along a radial direction in a cross section of the cylindrical shape. That is to say, the supporting member 22 is plate-shaped and extends along the radial direction in the cross section in the cylindrical shape of the casing 2, and both ends of the supporting member 22 are connected to an inner wall of the earpiece 21. The holes 23 are spaces (gaps) that exist between the supporting member 22 and the inner wall of the earpiece 21.

A woofer 3 and a tweeter 4 are disposed in the casing 2. The woofer 3 includes a first piezoelectric element 32 attached to the first vibration plate 31, and one end of the woofer 3 is embedded in (connects to) the supporting member 22. When a voltage is applied to the first piezoelectric element 32 to cause vibration, the first vibration plate 31 vibrates, and the woofer 3 transmits the vibration to the earpiece 21 via the supporting member 22. The vibration of the earpiece 21 is transmitted to the ear canal cartilage 6 (FIG. 1). Further, although the woofer 3 may have a unimorph configuration using a 1 piezoelectric element, the woofer 3 may have a bimorph configuration formed by stacking 2 piezoelectric elements or a stacked configuration by stacking multiple piezoelectric elements (3 or more).

One end of each of the first vibration plate 31 and first piezoelectric element 32 is connected to the supporting member 22, and weights 33 are attached to the other end opposite to the one end. The weight 33 of the first vibration plate 31 lowers a resonant frequency of the first vibration plate 31, the weight 33 of the first piezoelectric element 32 lowers a resonant frequency of the first piezoelectric element 32, and frequency characteristics of the woofer 3 are improved.

One end of the woofer 3 is arranged at the ear canal 7 side end portion of the casing 2 and is embedded in the supporting member 22 arranged along the radial direction in the cylindrical cross sectional shape, and thus the woofer 3 is disposed so as to extend along the axis of the cylindrical shape of the casing 2. Thus the woofer 3 transmits vibration nearly uniformly to each location of the cylindrically-shaped earpiece 21. Further, when the voltage is applied to the first piezoelectric element 32, the woofer 3 vibrates in a direction orthogonal to a boundary between the first vibration plate 31 and the first piezoelectric element 32.

The tweeter 4 is piezoelectric element-type speaker in which the second piezoelectric element 42 is attached to the second vibration plate 41. When the voltage is applied to the second piezoelectric element 42 to cause vibration, the second vibration plate 41 vibrates, and the tweeter 4 outputs sound (compression waves in air) within the casing 2. The outputted sound, using air as a medium, passes through the hole 23 and is transmitted to the ear canal 7.

Figure 3:
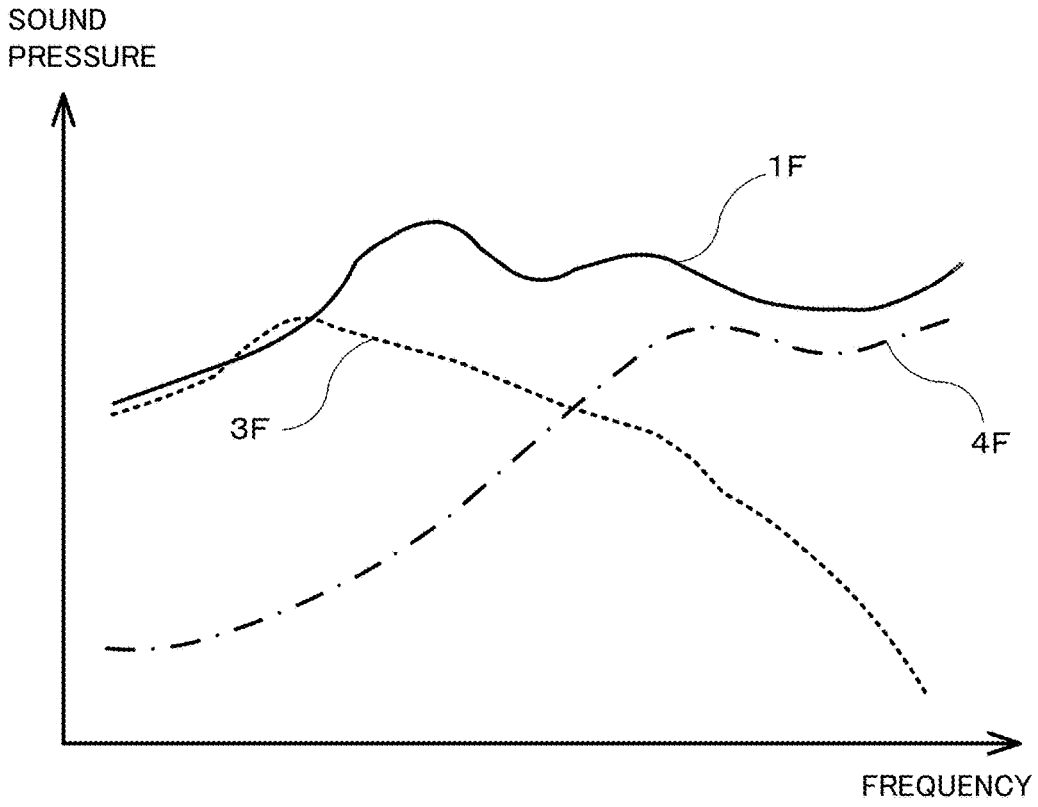
FIG. 3 is a graph illustrating frequency characteristics (Embodiment 1)

FIG. 3 is a drawing illustrating frequency characteristics of the earphone 1, the woofer 3, and the tweeter 4. As illustrated in FIG. 3, in frequency characteristics 3F of the woofer 3, sound pressure is high in the low frequencies due to the effect of the weight 33. However, in frequency characteristics 4F of the tweeter 4, sound pressure is high in the high frequencies due to the characteristics of a piezoelectric element-type tweeter. In frequency characteristics 1F of the earphone 1 that combine these characteristics, sound pressure is high in both the low frequencies and the high frequencies.

The vibration generated by the woofer 3 is transmitted to the ear canal cartilage 6 via the earpiece 21, and the sound output from the tweeter 4 is transmitted to the ear canal 7. Both of the vibration and sound are transmitted to the eardrum of only the side of the head wearing the earphone 1 (are not transmitted to the eardrums of both the right and left ears). By this means, when earphones 1 are worn separately in the right and left ears, the right and left sounds are reliably separated, and sound is localized.

As described above in detail, the earphone 1 of the present embodiment uses bone conduction to transmit the vibration generated by the woofer 3, and uses transmission by air conduction to transmit the sound output from the tweeter 4, and thus good frequency characteristics can be obtained. Further, the sound undergoes lateral separation, enabling localization of sound.

Further, by disposal of the first vibration plate 31 within the casing 2 and near sealing of air within the casing 2 by the casing 2 when the earphone 1 is worn, and by arranging of a portion of the first vibration plate 31 in the ear canal 7 side end portion of the casing 2 to embed in the supporting member 22 arranged radially in the cross section of the cylindrical shape, vibrations of the first vibration plate 31 and the casing 2 can be efficiently transmitted to the ear canal cartilage 6, and sound leakage can be decreased.

Further, the tweeter 4 may be omitted, and sound of the woofer 3 alone may be transmitted.

Embodiment 2

The earphone of Embodiment 2 differs from the earphone 1 of Embodiment 1 in that configuration of the woofer 3 is different. Other portions are similar to those of Embodiment 1, and detailed explanation of such portions is omitted.

Figure 4A:
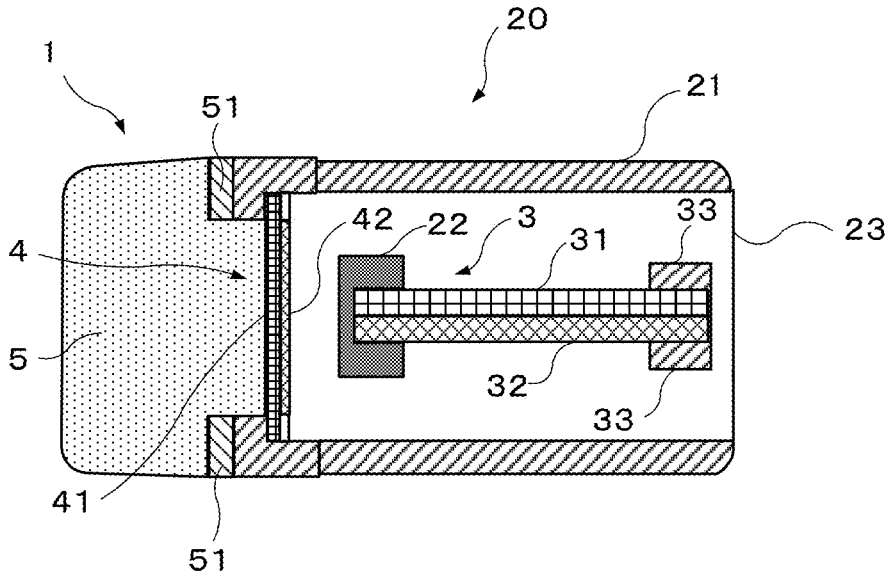
FIG. 4A is a schematic drawing (cross-sectional drawing of the casing) illustrating a configuration of the earphone (Embodiment 2)
Figure 4B:
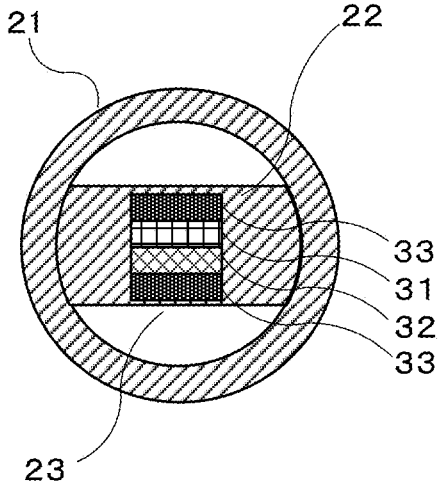
FIG. 4B is a schematic drawing (view of the casing as seen from the ear canal side) illustrating the configuration of the earphone (Embodiment 2)

FIG. 4A and FIG. 4B are schematic drawings illustrating a configuration of an earphone 20. FIG. 4A is a cross-sectional drawing of the casing 2, and FIG. 4B is a drawing of the casing 2 as viewed from the ear canal 7 side (from the right as viewed in FIG. 4A). When FIG. 2A and FIG. 2B are compared, for the earphone 20 of Embodiment 2, the supporting member 22 is arranged at the tweeter 4 side (leftward direction in the drawing), and the first vibration plate 31 and the first piezoelectric element 32 are arranged at the ear canal 7 side (rightward direction in the drawing).

In this manner, even if the support position of the woofer 3 supported by the supporting member 22 is opposite to that of the earphone 1 of Embodiment 1, such configuration may be used if the earphone is the bone-conduction type earphone 20. The sound wave is not transmitted in the air, and thus the support position of the woofer 3 can be set as desired. However, in order to suppress the transmission of vibrations of the woofer 3 to the earphone main body 5 in the earphone 20 of the present embodiment, the damping member 51 is quite preferably disposed between the earphone main body 5 and the casing 2.

The earphone 20 of the present embodiment 2 has effects similar to those of the earphone 1 of Embodiment 1.

Embodiment 3

The earphone of the present Embodiment 3 uses a plurality of the woofers 3. Other portions are similar to those of the earphones 1 and 20 of Embodiments 1 and 2, and detailed explanation of such portions is omitted.

Figure 5:
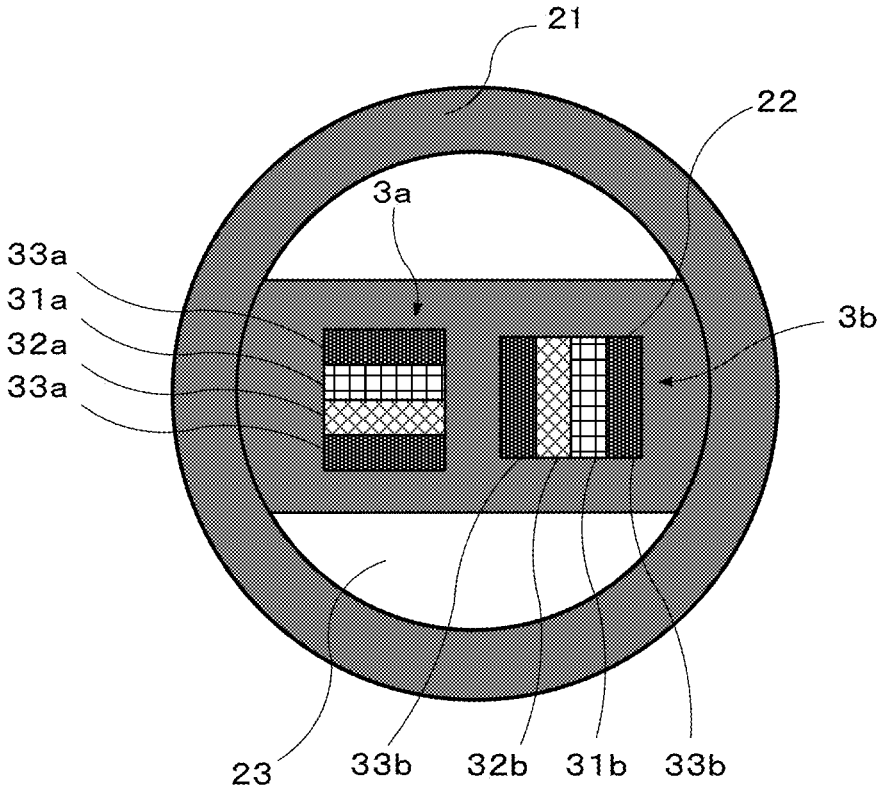
FIG. 5 is a drawing illustrating a configuration of vibration plates (Embodiment 3).

FIG. 5 is a drawing illustrating a configuration of vibration plates, and is a drawing corresponding to FIG. 4B of Embodiment 2. That is to say, FIG. 5 of Embodiment 3 corresponds to the view looking at the interior of the casing 2 from the ear canal 7 side.

The earphone illustrated in FIG. 5 includes two woofers, a woofer 3*a* and a woofer 3*b*. The woofers 3*a* and 3*b* are the same as the woofer 3 of the earphones 1 and 20 of Embodiments 1 and 2. Directions of vibration (direction orthogonal to a boundary between the vibration plate 31*a* (31*b*) and piezoelectric element 32*a* (32*b*)) of the woofers 3*a* and 3*b* are different by 90°.

The vibrations of the woofers 3*a* and 3*b* are transmitted to the earpiece 21 (and to the ear canal cartilage 6) via the supporting member 22. During such transmission, the vibrations transmitted to the ear canal cartilage 6 may be damped (may be transmitted to the air) depending on the relationship of relative connection between the earpiece 21 and the supporting member 22 (rather than asserting specifically that the vibration at one of the angles is damped, here the possibility of damping is asserted). Due to imparting of vibrations as 2 vibrations at angles that differ by 90°, the earphone of Embodiment 3 thus can ameliorate such damping. That is to say, the earphone of Embodiment 3 is anticipated to cause a lowering of the amount of sound leakage.

Further, the woofers 3 (3*a*, 3*b*, and the like) of the earphone of the present Embodiment 3 are not limited to 2 woofers, and the earphone may be equipped with 3 or more woofers. Further, for the earphone of Embodiment 3, the angle between the mutually different vibration directions of the woofers 3*a*, 3*b*, and the like can be determined by design as desired. For example, in the earphone of the present Embodiment 3, the woofer 3*b* vibrates in a direction parallel to the radial direction in which the supporting member 22 is arranged, and the woofer 3*a* vibrates in a direction perpendicular to the direction parallel to the radial direction in which the supporting member 22 is arranged. However, the woofers 3*a* and 3*b* may vibrate in 2 directions so that the respective directions of vibration of the woofers 3*a* and 3*b* are tilted by 45° relative to each other.

The earphone of the present Embodiment 3 enables the reliable obtaining of effects similar to those of the earphones 1 and 20 of Embodiments 1 and 2.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2015-122034, filed on Jun. 17, 2015, including the specification, claims, and drawings, the entire disclosure of which is incorporated by reference herein.

INDUSTRIAL APPLICABILITY

The present disclosure is considered for many individuals and audio equipment manufacturers to have many applications related to miniaturized and light-weight bone-conduction type earphones that have a low amount of sound leakage.

REFERENCE SIGNS LIST

1, 20 earphone
1F earphone frequency characteristics
2 casing
21 earpiece
22 supporting member
23 hole
3, 3*a*, 3*b* woofer
31, 31*a*, 31*b* first vibration plate
32, 32*a*, 32*b* first piezoelectric element
33 weight
3F woofer frequency characteristics
4 tweeter
41 second vibration plate
42 second piezoelectric element
4F tweeter frequency characteristics
5 earphone main body
51 damping member
6 ear canal cartilage
7 ear canal

The invention claimed is:

1. An earphone comprising:
a first vibration plate for vibration by a first piezoelectric element; and
a casing disposed with the first vibration plate, for transmitting to an ear canal cartilage the vibration of the first vibration plate, wherein
the casing has a cylindrical shape and is inserted into an ear canal,
the first vibration plate is disposed within the casing,
the casing comprises a plate-shaped supporting member arranged radially as viewed extending along a radial direction in a cross section of the cylindrical shape of the casing, the supporting member being arranged at an end of the casing, the end of the casing being located forward in a direction in which the casing is inserted into the ear canal, and
one end of the first vibration plate connects to the supporting member, and the first vibration plate is disposed along an axis of the cylindrical shape of the casing.

2. The earphone according to claim 1, wherein
the first vibration plate includes a weight disposed at another end of the first vibration plate opposite to the end of the first vibration plate connecting to the supporting member.

3. The earphone according to claim 1, further comprising:
at least two of the first vibration plates, wherein
among the at least two first vibration plates, two of the first vibration plates oscillate in mutually orthogonal directions.

4. The earphone according to claim 1, comprising:
the casing and an earphone main body, wherein the earphone further comprises:
vibration transmission damping mechanism disposed between the casing and the earphone main body.

5. The earphone according to claim 1, further comprising:
a second vibration plate for vibration by a second piezoelectric element; and
a hole, disposed in the casing, for transmitting to the ear canal an air vibration generated by the second vibration plate.

6. An earphone comprising:
a first vibration plate for vibration by a first piezoelectric element; and
a casing disposed with the first vibration plate, for transmitting to an ear canal cartilage the vibration of the first vibration plate, wherein
the casing has a cylindrical shape and is inserted into an ear canal,
the first vibration plate is disposed within the casing,
the casing comprises a supporting member arranged radially as viewed in a cross section of the cylindrical shape of the casing, and
one end of the first vibration plate connects to the supporting member, and the first vibration plate is disposed along an axis of the cylindrical shape of the casing, wherein the earphone includes at least two of the first vibration plates, wherein among the at least two first vibration plates, two of the first vibration plates oscillate in mutually orthogonal directions.

7. An earphone comprising:
a first vibration plate for vibration by a first piezoelectric element; and
a casing disposed with the first vibration plate, for transmitting to an ear canal cartilage the vibration of the first vibration plate, wherein
the casing has a cylindrical shape and is inserted into an ear canal,
the first vibration plate is disposed within the casing,
the casing comprises a supporting member arranged radially as viewed in a cross section of the cylindrical shape of the casing,
one end of the first vibration plate connects to the supporting member, and the first vibration plate is disposed along an axis of the cylindrical shape of the casing
a second vibration plate for vibration by a second piezoelectric element; and
a hole disposed in the casing, for transmitting to the ear canal an air vibration generated by the second vibration plate.

* * * * *